US009501039B2

(12) United States Patent
Kaltenrieder et al.

(10) Patent No.: US 9,501,039 B2
(45) Date of Patent: Nov. 22, 2016

(54) WATCH INCLUDING A BEZEL AND METHOD OF ATTACHING SUCH BEZEL

(75) Inventors: Andre Kaltenrieder, Preles (CH); Martin Jufer, Meichnau (CH); Christian Racine, Malleray-Bevilard (CH); Jean-Luc Bovet, Solothurn (CH); Jerome Grosjean, Orvin (CH)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 0 days.

(21) Appl. No.: 13/979,057

(22) PCT Filed: Feb. 6, 2012

(86) PCT No.: PCT/EP2012/051974

§ 371 (c)(1),
(2), (4) Date: Aug. 20, 2013

(87) PCT Pub. No.: WO2012/107408

PCT Pub. Date: Aug. 16, 2012

(65) Prior Publication Data

US 2013/0329535 A1 Dec. 12, 2013

(30) Foreign Application Priority Data

Feb. 8, 2011 (EP) ..... 11153707

(51) Int. Cl.

| | |
|---|---|
| ***G04B 39/00*** | (2006.01) |
| ***G04B 39/02*** | (2006.01) |
| ***G04G 17/04*** | (2006.01) |

(52) U.S. Cl.

CPC ..... *G04B 39/02* (2013.01); *G04G 17/045* (2013.01)

(58) Field of Classification Search

CPC ..... G04B 39/00
USPC ..... 368/294
See application file for complete search history.

(56) References Cited

U.S. PATENT DOCUMENTS

| | | | | |
|---|---|---|---|---|
| 4,993,007 | A * | 2/1991 | Meister | 368/294 |
| 6,053,631 | A | 4/2000 | Mock et al. | |
| 6,243,259 | B1 | 6/2001 | Yamakawa et al. | |
| 7,009,915 | B2 * | 3/2006 | Brewer et al. | 368/71 |
| 2003/0142589 | A1 | 7/2003 | Ebi | |
| 2006/0256667 | A1 * | 11/2006 | Wyssbrod | G04B 39/02 368/294 |

FOREIGN PATENT DOCUMENTS

| | | |
|---|---|---|
| CH | 661 635 | 8/1987 |
| EP | 1 331 530 | 7/2003 |

OTHER PUBLICATIONS

International Search Report Issued May 30, 2012 in PCT/EP12/051974 Filed Feb. 6, 2012.

* cited by examiner

*Primary Examiner* — Amy Cohen Johnson
*Assistant Examiner* — Jason Collins
(74) *Attorney, Agent, or Firm* — Oblon, McClelland, Maier & Neustadt, L.L.P.

(57) ABSTRACT

A watch and a method of ultrasonic welding a bezel to the watch at a middle part. The watch includes: a middle part which, with a crystal, delimits a watch case, the crystal being bonded to a shoulder arranged in the watch middle part; and a bezel ultrasonically welded both to the crystal and to the watch middle part.

5 Claims, 1 Drawing Sheet

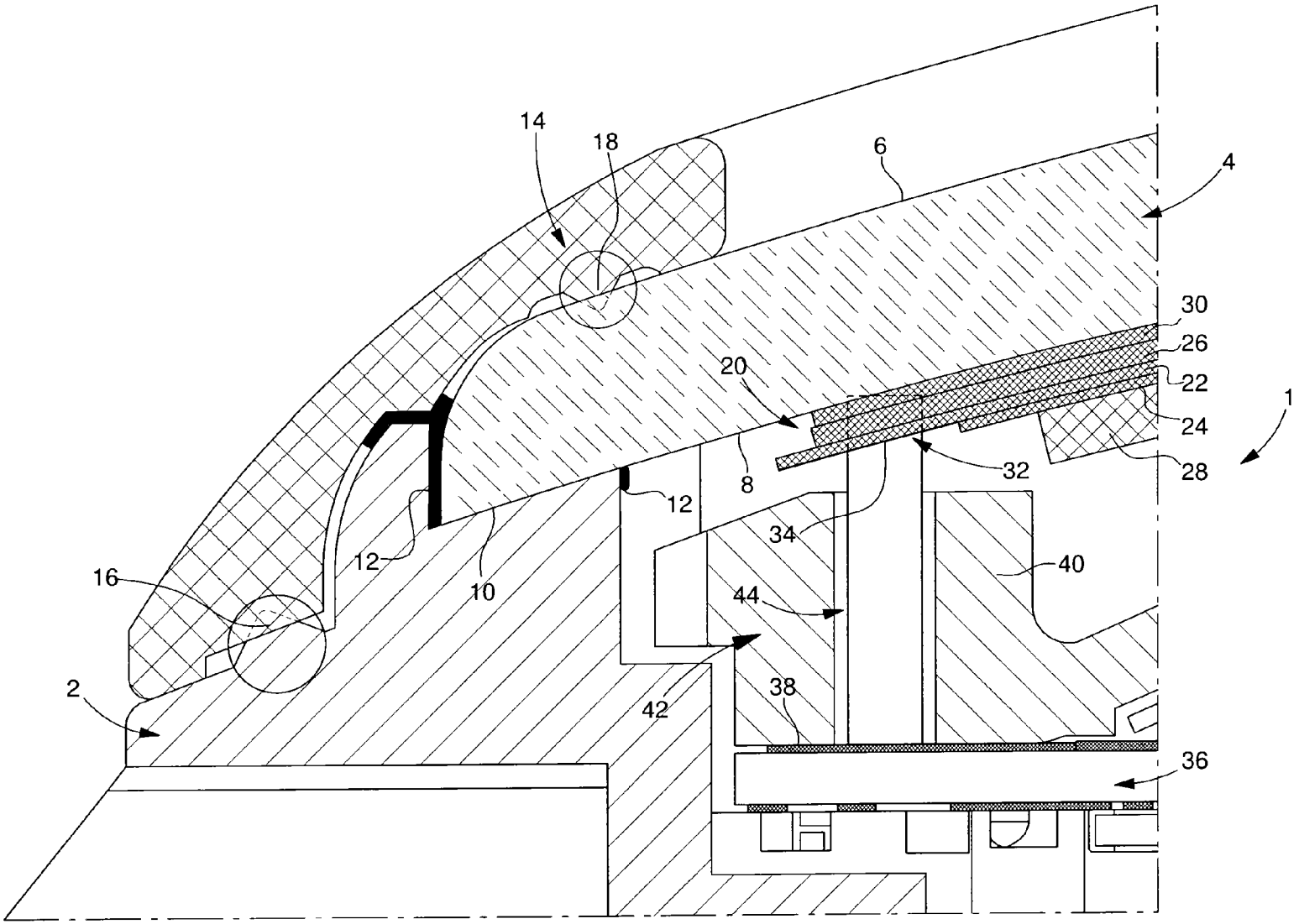
1
4
30
26
22
24
28
36
40
32
6
34
38
44
20
8
42
12
18
14
10
12
16
2

WATCH INCLUDING A BEZEL AND METHOD OF ATTACHING SUCH BEZEL

This is a National Phase Application in the United States of International Patent Application PCT/EP 2012/051974 filed Feb. 6, 2012, which claims priority on European Patent Application No 11153707.2, filed Feb. 8, 2011 The entire disclosures of the above patent applications are hereby incorporated by reference.

FIELD OF THE INVENTION

The present invention concerns a watch comprising a bezel in addition to a method of securing the bezel. More specifically, the present invention concerns a watch comprising a bezel enabling a crystal to be secured in a perfectly sealed and long-lasting manner.

BACKGROUND OF THE INVENTION

In the case of a watch crystal made of an organic material such as a plastic material, it is preferable to use an ultrasonic technique for welding this type of crystal to a watch middle part which is also made of plastic. Indeed, the ultrasonic welding technique allows the crystal to be secured to the watch middle part in a perfectly sealed and long-lasting manner. However, there are cases where the ultrasonic welding technique is not appropriate. This is particularly true when elements are sensitive to mechanical and thermal stresses. In such cases, it is preferable to use bonding techniques which do not result in any increase in temperature. However, bonding techniques raise other problems. They do not always guarantee a good quality seal and raise problems of wear over time. Moreover, after bonding the parts, a polymerisation time has to be observed, which is usually twenty-four hours. There is a thus an interruption to the flow of production, which is detrimental from an economic point of view.

SUMMARY OF THE INVENTION

It is an object of the present invention to overcome these problems by providing a bezel which allows a sealed and long-lasting assembly of a watch crystal bonded to a middle part.

The present invention therefore concerns a watch comprising a middle part which, with a crystal, delimits a watch case, the crystal being bonded onto a specific shoulder in the middle part, the watch being characterized in that it includes a bezel which is ultrasonic welded both to the crystal and to the middle part.

The present invention also concerns a method of securing a watch bezel, said watch comprising a middle part which, with a crystal, delimits a watch case, said method being characterized in that it consists in bonding the crystal onto a shoulder arranged in the middle part, then in ultrasonic welding the bezel both to the crystal and to the middle part, wherein the ultrasonic welding step can be performed even though the bond is not yet dry.

As a result of these features, the present invention provides a watch whose bezel, which is ultrasonic welded to the crystal and the middle part, allows a perfectly sealed and long-lasting assembly of the crystal, although the latter is merely bonded onto the middle part. Indeed, the bezel abuts both on the crystal and on the middle part so that, once ultrasonic welded, it secures and seals perfectly the assembly formed by the crystal and the middle part. Moreover, the step of ultrasonic welding the bezel may take place shortly after the crystal is bonded onto the middle part. It is no longer necessary to wait for the bond to polymerise in order to continue with the steps of assembling the watch according to the invention. This represents a considerable time saving and above all, allows a continuous flow of work, with no interruption to the manufacturing method.

Moreover, ultrasonic welding the bezel results in a solid assembly offering, in particular, excellent resistance to the permanent opposing forces exerted by two flexible connectors.

BRIEF DESCRIPTION OF THE DRAWINGS

Other features and advantages of the present invention will appear more clearly from the following detailed description of one embodiment of the watch according to the invention, this example being given solely by way of non-limiting illustration with reference to the annexed drawing, in which FIG. 1 is a partial cross-section of a watch case according to the invention.

DETAILED DESCRIPTION OF THE PREFERRED EMBODIMENTS

The present invention proceeds from the general inventive idea which consists in keeping a crystal bonded to a watch middle part by means of a bezel which is itself ultrasonic welded both to the crystal and to the middle part. Since the bezel abuts both on the crystal and on the middle part, it is possible to make the mounting of the crystal onto the watch middle part perfectly sealed and long-lasting, even though the crystal is merely bonded and not welded. This is particularly advantageous when, because of the presence, for example, of elements sensitive to mechanical and thermal stresses, it is not possible to envisage ultrasonic welding the crystal to the middle part. Moreover, it is possible to ultrasonic weld the bezel just after the crystal is bonded, without having to wait for the bond to dry, which does not interrupt the flow of production.

FIG. 1 annexed to this Patent Application is a partial cross-section of a watch case according to the invention. Designated as a whole by the general reference numeral 1, this watch case is delimited by a middle part 2, closed at the top by a crystal 4. Middle part 2 and watch crystal 4 are made of materials suitable for bonding. Purely by way of non-limiting example, crystal 4 is made of polymethyl methacrylate or PMMA, while middle part 2 is made of acrylonitrile butadiene styrene or ABS.

Watch crystal 4 has two surfaces, namely a top surface 6 facing the watch user side and a bottom surface 8 facing the watch case 1 side. Crystal 4 abuts on a shoulder 10 of middle part 2. Crystal 4 is secured to watch middle part 2 by means of a line of adhesive 12. Crystal 4 is thus merely bonded to shoulder 10 arranged in watch middle part 2 and does not abut on a dial or any other part of the watch through which the ultrasonic energy could be transmitted to and damage the watch movement.

Immediately after crystal 4 has been bonded to middle part 2, crystal 4 can be permanently immobilised and the assembly thereof to middle part 2 is sealed perfectly by means of a bezel 14 which, as seen in the drawing, rests both on crystal 4 and on middle part 2. Preferably, but in a non-limiting manner, bezel 14 is made of M-ABS, i.e. transparent ABS.

According to the invention, bezel 14 is fixed to crystal 4 and middle part 2 by ultrasonic welding. For the purposes of ultrasonic welding, a first annular collar 16 is arranged on the external periphery of middle part 2 and a second annular collar 18 is provided underneath the surface of bezel 14. These two collars 16 and 18 are provided at the places where bezel 14 abuts against middle part 2, respectively crystal 4. These two collars 16 and 18 play the part of ultrasonic energy directors and represent a supply of thermoplastic matter which will be consumed during the welding method. The fraction of collars 16 and 18 which is consumed during welding is shown in dotted lines in areas surrounded by a circle in FIG. 1. It is thus clear that ultrasonic energy is provided in two distinct areas, on the one hand in a first area where bezel 14 is abutting on crystal 4 and, on the other hand, in a second area where bezel 14 is abutting on middle part 2. Since the ultrasonic energy is provided in two distinct areas respectively corresponding to the weld of bezel 14 to crystal 4 and to the weld of bezel 14 to middle part 2, the intensity of the ultrasonic energy provided in these two areas remains within acceptable limits which are not liable to cause damage to the internal watch components. This is not the case where ultrasonic energy is supplied in a single area for simultaneously welding the bezel to the crystal and the middle part. In that case, the intensity of ultrasonic energy applied is high and there is a high risk of damage to the internal watch components.

A digital display device is fixed to the bottom surface 8 of crystal 4. Purely by way of non-limiting example, this digital display device may be a liquid crystal display cell 20 comprising a front substrate 22 and a rear substrate 24 extending parallel to and at a distance from each other and joined to each other by a sealing frame (not shown in the drawing) which delimits a sealed volume for confining the liquid crystal. The two front 22 and rear 24 substrates are arranged between first and second polarisers, respectively 26 and 28, with intersecting directions of polarisation. The assembly formed by the two substrates 22 and 24 and the two polarisers 26 and 28 is bonded by means of a film of optical adhesive 30 to the bottom surface 8 of watch crystal 4.

It can be seen upon examining the drawing that the dimensions of front substrate 22 exceed those of rear substrate 24. This forms a contact surface 32, to which the conductive paths 34 lead for the electrical connection of the control electrodes of display cell 20 to the electronic control components (not shown) of cell 20. These electronic control components are mounted on a printed circuit board 36 arranged inside watch case 1, underneath display cell 20 and at a distance therefrom. The conductive paths 34 for the electrical connection of the control electrodes of liquid crystal display cell 20 are connected to corresponding conductive paths 38 structured on the surface of the printed circuit board 36 by means of an elastomer connector 40 which extends substantially vertically. It will be recalled that an elastomer connector, also known by the commercial name of a zebra connector, is a flexible connector formed of a plurality of conductive sheets separated from each other by elastomer insulating sheets. The assembly is completed by a light guide 42 which is carried by a printed circuit board 36 and which is used to backlight liquid crystal display cell 20. It will be noted that light guide 42 optionally includes a slot 44 for guiding and vertically holding zebra connector 40.

According to the invention, the level of shoulder 10 relative to printed circuit board 36 is such that when crystal 4 is bonded to middle part 2, zebra connector 40 is compressed. The compressed portion of zebra connector 40 is shown in dotted lines in FIG. 1. This particular case reveals all the advantages of the invention. Firstly, since a liquid crystal cell 20 is bonded to the bottom surface 8 of crystal 4, the fact that crystal 4 is bonded to middle part 2 avoids any risk of damaging cell 20. Secondly, given that zebra connector 40 is arranged compressed between liquid crystal display cell 20 and printed circuit board 36, it tends to try to return to its initial shape and exerts a stress on crystal 4 which tends to detach crystal 4 from middle part 2. Consequently, without bezel 14, which is ultrasonic welded to middle part 2 shortly after crystal 4 is bonded, the assembly formed by crystal 4 and middle part 2 would have to be polymerised for at least twenty-four hours under stress, which would complicate manufacturing operations and break the flow of production.

It goes without saying that this invention is not limited to the embodiments that have just been described and that various simple alterations and variants can be envisaged by those skilled in the art without departing from the scope of the invention as defined by the annexed claims.

What is claimed is:

1. A watch comprising:

a crystal having a top surface and a bottom surface;

a middle part which, along with the crystal, delimits a watch case, a portion of the bottom surface of the crystal only abutting on a shoulder arranged in the watch middle part to which the crystal is bonded; and a bezel ultrasonically welded both to the crystal and to the watch middle part, wherein a first annular collar is arranged on the middle part and a second annular collar is provided on the bezel, wherein the first annular collar is located at a position where the bezel abuts against middle part, and the second annular collar is located on a bottom surface of the bezel at a position where the bezel abuts against the top surface of crystal, wherein the first and second annular collars area supply of matter that is consumed during the ultrasonic welding, and wherein a digital display device is fixed to the bottom surface of the crystal.

2. The watch according to claim 1, further comprising:

a printed circuit board arranged in the watch case underneath the digital display device and at a distance therefrom, the digital display device being electrically connected to the printed circuit board by a zebra type electrical connector, the crystal abutting on the shoulder arranged in the watch middle part, a height of the shoulder relative to the printed circuit board being such that, when the crystal is joined to the shoulder, the zebra connector is compressed between the digital display and the printed circuit board.

3. The watch according to claim 1, wherein the first annular collar and the second annular collar a made of thermoplastic matter.

4. A method of securing a bezel of a watch, the watch including a middle part which, with a crystal, delimits a watch case, the method comprising:

bonding the crystal to a shoulder arranged in the watch middle part; and ultrasonic welding the bezel both to the crystal and to the watch middle part, the ultrasonic welding being capable of being performed even though the bond is not yet dry, ultrasonic energy being provided in two distinct areas, the two distinct areas include a first annular collar area where the bezel is surface abutting the middle part, and a second annular collar area where a bottom surface of the bezel is surface abutting a top surface of the crystal, wherein the first and second annular collars are consumed during the ultrasonic welding, and wherein a digital display device is fixed to a bottom surface of the crystal.

5. The method according to claim 4, wherein the first annular collar and the second annular collar are made of thermoplastic matter.

* * * * *